US006206589B1

(12) United States Patent
Bjork et al.

(10) Patent No.: US 6,206,589 B1
(45) Date of Patent: Mar. 27, 2001

(54) PRINTER RIBBON COMPENSATION

(75) Inventors: Paul E. Bjork, Stillwater; Matthew K. Dunham, Eagan, both of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/406,276

(22) Filed: Sep. 24, 1999

(51) Int. Cl.[7] ..... B41J 2/315

(52) U.S. Cl. ..... 400/120.13; 400/208; 347/177; 347/193

(58) Field of Search ..... 400/120.11, 207, 400/208, 120.02, 120.13; 347/177, 178, 188, 190, 193, 194, 211, 214

(56) References Cited

U.S. PATENT DOCUMENTS 4,630,069 * 12/1986 Erlichman ..... 347/177
4,851,861 * 7/1989 Kikuchi et al. ..... 347/214
5,070,342 * 12/1991 Okumura et al. ..... 400/120.13
5,266,968 * 11/1993 Stephenson ..... 400/207
5,274,395 * 12/1993 Mizoguchi et al. ..... 400/120.13
5,305,020 * 4/1994 Gibbons et al. ..... 347/177
5,384,584 * 1/1995 Yoshida et al. ..... 347/214
5,636,926 * 6/1997 Yamaguchi ..... 347/178
5,841,459 11/1998 Wen ..... 347/176
5,946,020 * 8/1999 Rogers et al. ..... 347/193
6,071,024 * 6/2000 Chiming et al. ..... 347/177

FOREIGN PATENT DOCUMENTS 2870574 3/1999 (JP) .

* cited by examiner

*Primary Examiner*—Eugene Eickholt
(74) *Attorney, Agent, or Firm*—Westman, Champlin & Kelly, P.A.

(57) ABSTRACT

The printer is adapted to print an image onto a substrate using a web carrying a color material. The printer includes a web supply configured to supply the web and a web take-up configured to receive the web. A print head is configured to material from the web to the substrate. A controller provides a control signal to the web take-up or web supply as a function of heat energy applied to the web.

33 Claims, 3 Drawing Sheets

PRINTER RIBBON COMPENSATION

BACKGROUND OF THE INVENTION

The present invention relates to printers. More specifically, the present invention relates to printers which use a ribbon and a technique for controlling movement of the ribbon used in the printer.

Dye sublimation ribbon based printers use a ribbon which carries primary color panels to print an image. For example, the ribbon can carry yellow, magenta and cyan (YMC) for printing full color images on a variety of different types of medium. Typically, a thermal print head is used to heat the ribbon and cause ink on the color panels to be released and to adhere to the medium. For example, some plastic identification card printers use a ribbon which carries color panels to print onto a plastic substrate. The identification card printer can use a print head which carries a series of resistive thermal elements which are controlled by a circuit in a microcontroller using an algorithm to provide the correct level of heat for optimally printing each color panel.

Their image quality is affected by a number of factors including the quality of the dye and the accuracy of the head control. High definition, high quality images are desirable. This improves the legibility of the card as well as the security by reducing the ability to forge the card. Much of the prior art has focused on the particular dye or substrate used or the control algorithm used to control movement of the print head and heating of resistive elements in the head.

The alignment between the image printed on color panels and the media is critical. Failure to achieve proper alignment will result in image smearing or the introduction of a shadow into the printed image.

SUMMARY OF THE INVENTION

The present invention includes a technique for providing accurate control of a dye carrying web in a thermal printer. The printer is adapted to print an image onto a substrate using a web carrying color material. The printer includes a web supply configured to supply the web and a web take-up configured to receive the web. A print head is configured to transfer material from the web to the substrate. A controller controls the web take-up or web supply as a function of temperature.

DETAILED DESCRIPTION OF THE ILLUSTRATIVE EMBODIMENTS

Thermal dye sublimation printers such as plastic identification card printers use a dye sublimation web based ribbon which consists of a polymer based film with separate dye panels for each of the primary colors, yellow, magenta and cyan (YMC). Frequently, a resin black panel and/or a clear overlay panel are provided for laminating the identification card using the print head as a heat source.

The print head is controlled by a circuit which is driven by a microcontroller with an algorithm configured to optimally control the print head current/voltage level to form the pixels which are used to heat the ribbon and thereby release the ribbon dye into the substrate material. The substrate is indexed in a direction normal to the print head movement to provide for printing of a single image on the card using each of the colored panels. The algorithm used to control the print head is often optimized to provide for the highest quality pixel formation. Further, the heat applied using the print head can be optimized for a particular dye and/or type of ribbon. Darker colors require higher heat levels to provide for the best dye release.

Each of the three color panels require different power levels (voltage and current) to provide the correct heat level. It has been discovered that the ribbon stretches as a function of the heat energy applied to the web. This stretch results in poor image quality. Drive motors which move the ribbon can be controlled in an optimal manner to provide the correct web speed for each separate panel color to compensate for ribbon web stretch and the associated card image stretch which results from the application of heat from the thermal print head to the ribbon.

The invention provides an apparatus and method for compensating for ribbon stretch and for optimally printing onto a plastic identification card with a dye sublimation ribbon and a thermal print head.

Figure 1:
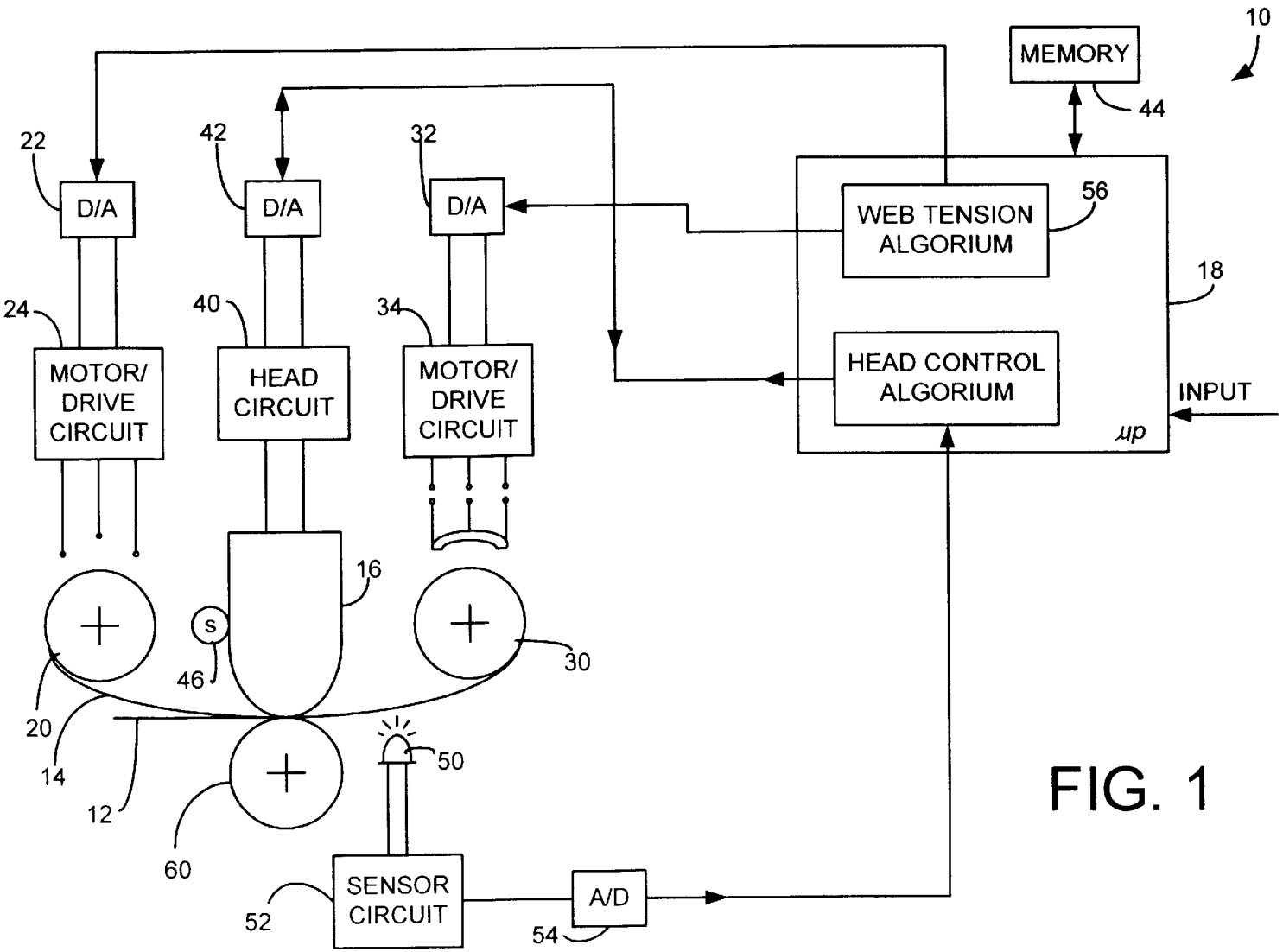
FIG. 1 is a simplified block diagram of a printer which compensates for ribbon stretch in accordance with one embodiment of the present invention.

FIG. 1 is a simplified diagram of a thermal dye sublimation printer 10 in accordance with one embodiment of the present invention. Dye sublimation 10 is illustrated printing onto a substrate 12 such as an identification card. A ribbon or web 14 moves adjacent substrate 12 such that print head 16 can transfer an image into substrate 12 using dye carried on panels on ribbon 14. A controller, which can be embodied in a microprocessor 18, is used to control the printing process. Microprocessor 18 controls take-up spool (web take-up) 20 using digital to analog converter 22 which drives motor/drive circuit 24. Microprocessor 18 also controls ribbon spool and clutch (web supply) 30 using digital to analog converter 32 which controls motor/drive circuit 34. Print head 16 is controlled by microprocessor 18 using head circuit 40 which is responsive to digital to analog converter 42. As is known in the art, print head 16 contains a number of heater elements such as resistors which each correspond to a pixel. Each resistive element can be individually heated using head circuit 40 under the control of digital to analog converter 42 in accordance with a head control algorithm implemented in microprocessor 18. Programs for microprocessor 18, constants and temporary variables are stored in a memory 44.

A temperature sensor 46 is thermally coupled to print head 16 and provides an output through an analog to digital converter (not shown) to microprocessor 18 such that microprocessor 18 can monitor the temperature of print head 16 and web 14. A sensor 46 can optionally be provided and thermally coupled to web 14 to more accurately sense the temperature of web 14. Further, a ribbon or web sensor 50 provides an output to sensor circuitry 52 which is related to the color of the particular ribbon panel proximate sensor 50. This data is converted to a digital format by analog to digital converter 54 and provided to microprocessor 18. Microprocessor 18 implements a web tension algorithm 56 in accordance with the present invention.

During operation, the position of the ribbon web 14 is controlled by motor/drive circuit 24 which actuates the take-up spool 20 and indexes the ribbon after each pass of print head 16. The ribbon speed is also controlled by the microprocessor 18 which further controls movement of the print head 16 and its circuitry 40. Information describing the particular type of ribbon and panel can be carried on a bar code or other code which is carried on the ribbon. For example, a bar code can be provided between panels on the ribbon.

As the ribbon 14 is heated by the print head 16, the ribbon web 14 tends to stretch. This stretching is a function of the material properties of the polymer film, especially the Young's Modulus and Poisson's Ratio. Both of these properties are temperature dependent and tend to decrease with increasing temperature. Further, the stretch of the ribbon is different for different color panels because a different print head temperature is used. Different images can also alter the stretching relative to other panels because of the different number and patterns of pixels and pixel intensities. Friction between the ribbon 14, card or substrate 12 and platen roller 60 causes the speed of the substrate 12 to vary as the ribbon 14 stretches. This stretching results in variations in the size of the image which is printed on the substrate 12.

In general, printers that use constant ribbon web speed are prone to misregistration of the YMC color panels as well as the overlay ("O") and black ("K") panels on the ribbon 14 relative to the substrate 12 due to the different ribbon stretch for various panels. This misregistration results in the appearance of a shadow effect on the printed image. This also reduces the sharpness and color quality of the image.

With the present invention, the tension applied to the ribbon is controlled in a manner to compensate for ribbon stretch. The tension can be controlled using supply spool 30 or take-up spool 20. The invention includes a method for controlling the drive motors 24 and 34 using a web tension algorithm 56 implemented in microprocessor 18 to compensate for the ribbon stretch, preferably for each color panel.

Figure 2:
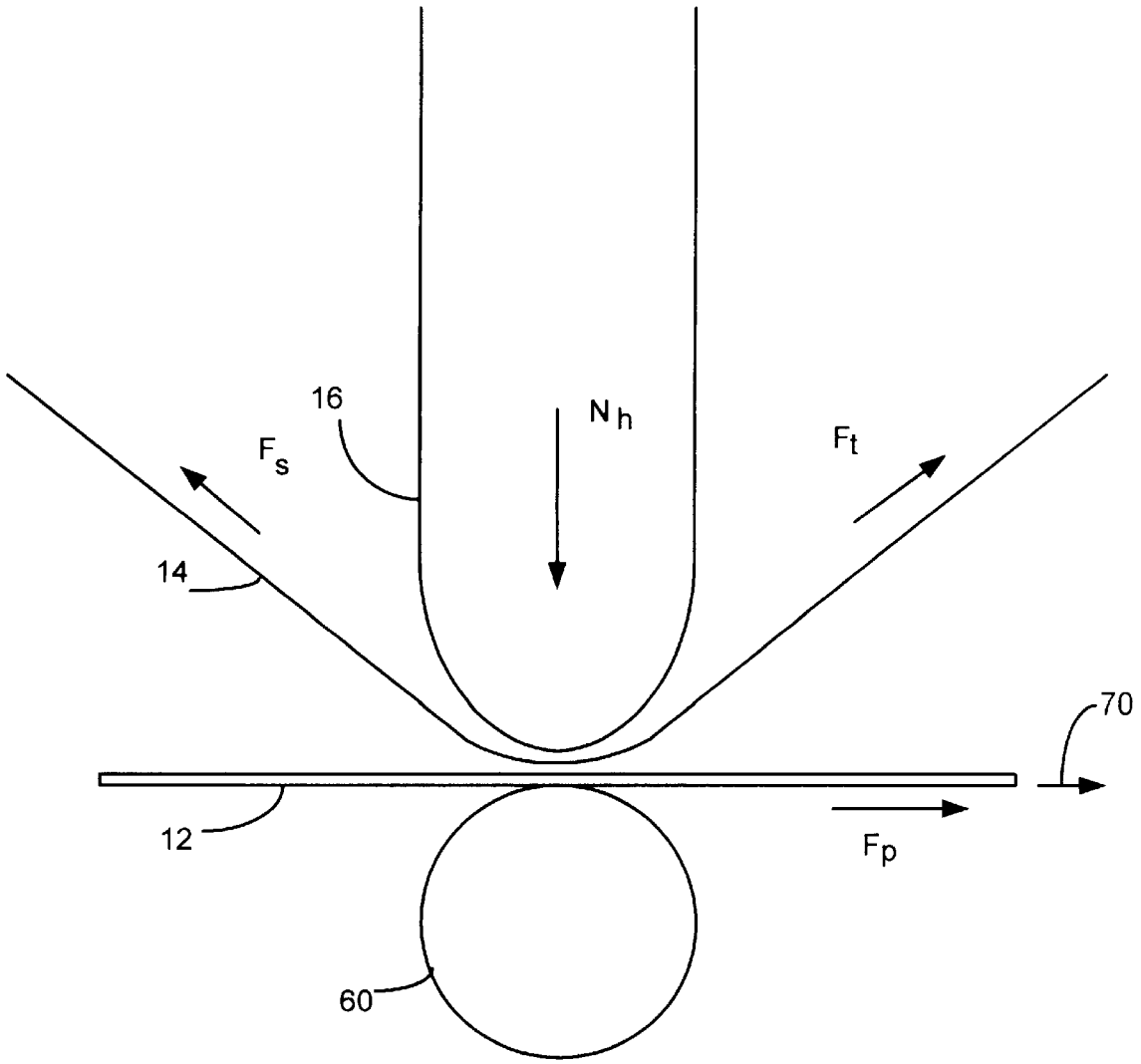
FIG. 2 is a diagram which illustrates forces on the ribbon of FIG. 1 during the printing process.

A control algorithm implemented in the present invention provides tension on the printer ribbon 14 and is preferably optimally adjusted to balance or compensate for image length variations caused by the heater induced ribbon stretching. This ribbon stretching arises due to the forces applied to the ribbon and the card. An idealized analysis of the forces acting on the card substrate 12 reveals that there are several primary factors. Ribbon drag force Fs from the supply, reel clutch or motor, ribbon tension Ft from the take-up reel, pressure Nh from print head 16 acting in a direction normal to the substrate 12, and the force Fp from platen 60 all contribute to this stretch. FIG. 2 is a simplified diagram showing the interaction of print head 16 with ribbon 14, substrate 12 and platen 60 and the resultant forces Fs, Nh, Ft and Fp as the substrate 12 moves in a direction indicated by arrow 70.

As head 16 heats ribbon 14, ribbon 14 tends to stretch due to the applied forces illustrated in FIG. 2. This stretching causes a localized acceleration in the region directly under head 16. A stretch factor for ribbon 14 is proportional to the thermal energy Eh applied by the head 16 at that time. The interaction between these forces, frictions and accelerations act together to cause unintended variations in the card velocity. This causes the length of the image on the card Lc which is printed for each color panel to be proportional to:

$$Lc \sim Fp+Ft-Fs+Kt*Eh \qquad \text{Eq.1}$$

A constant of thermal proportionality, Kt in Equation 1, is determined empirically or by analysis using basic thermal principles. Evaluation of the relationship shown in Equation 1 indicates that active control of the forces applied by the supply spool 30 or the take-up spool 20 can compensate for variations in length due to the heat energy. In one preferred embodiment, on a line by line basis, the microprocessor 18 of the present invention calculates the heat energy Eh delivered to the print head 16 and responsively reduces the ribbon tension by a proportional amount. The heat energy can also be measured using temperature sensor 46 or by measuring the power supplied to the heater elements of print head 16. The force for the take-up reel 20 which should be provided to compensate for the stretch should be:

$$Ft \sim Fc+Fs-(Kt*Eh) \qquad \text{Eq.2}$$

Control of the applied forces is further complicated because as the ribbon 14 is transferred from spool 30 to spool 20, the diameter of the respective reels changes. This causes the torque applied by the motors 24 and 34 to change due to the diameters. Thus, the algorithm implemented in microprocessor 18 preferably compensates for changes in the reel diameters and the resultant torque change.

The diameter of the take-up 20 and supply reels 30 can be estimated using any appropriate technique. For example, one simple technique is a position sensor coupled to a mechanical arm which rests against the reel. A multi-element optical detector illuminated by an LED can also be used and configured to measure this diameter. Reel speed can also be measured over time to determine the reel diameter. The angular velocity of the ribbon motor can also be estimated by observing the spectral noise impressed on the motor drive signal at harmonics of the angular velocity. Reel diameter can be inferred from information about the angular velocity of the ribbon motor and an approximation of the card velocity. A count can also be kept of the number of panels or images which have been printed. If the size of one reel is known, the size of the other reel can be estimated using information relating to ribbon length and ribbon thickness.

A preferred algorithm implemented in microprocessor 18 to compensate for ribbon stretching uses ribbon diameter as a input. The torque Tt on the take-up reel motor 24 is adjusted by estimating the size of the take-up reel rt and the size of the supply reel rs, and the supply reel clutch or supply motor torque Ts. The torque on the take-up reel Tt is as follows:

$$Tt=rt*(F+(Ts/rs)-(Kt*Eh)) \qquad \text{Eq.3}$$

Preferably, Equation 3 is calculated during each line printed by print head 16. F is the average desired ribbon take-up force which yields a predetermined image length for a very lightly deposited image. It has been observed that there is a non-linear or saturation effect in the web stretching or image size produced at high heater levels. This saturation effect can be compensated by limiting the Kt*Eh term to a predetermined maximum saturation value or through higher order terms in the torque Equation 3. The take-up reel torque Tt applied by motor 24 is adjusted by varying the control signal to digital to analog converter 22. For example, if the motor is driven using a pulse width modulation (PWM) technique, the width of the pulses can be modified to achieve the desired control. Other control techniques can also be used. The desired torque can be controlled using a closed feedback loop by measuring the instantaneous or average current and voltage characteristics of the motor, inferring the actual torque applied and responsively controlling the signal to the motor.

Figure 3:
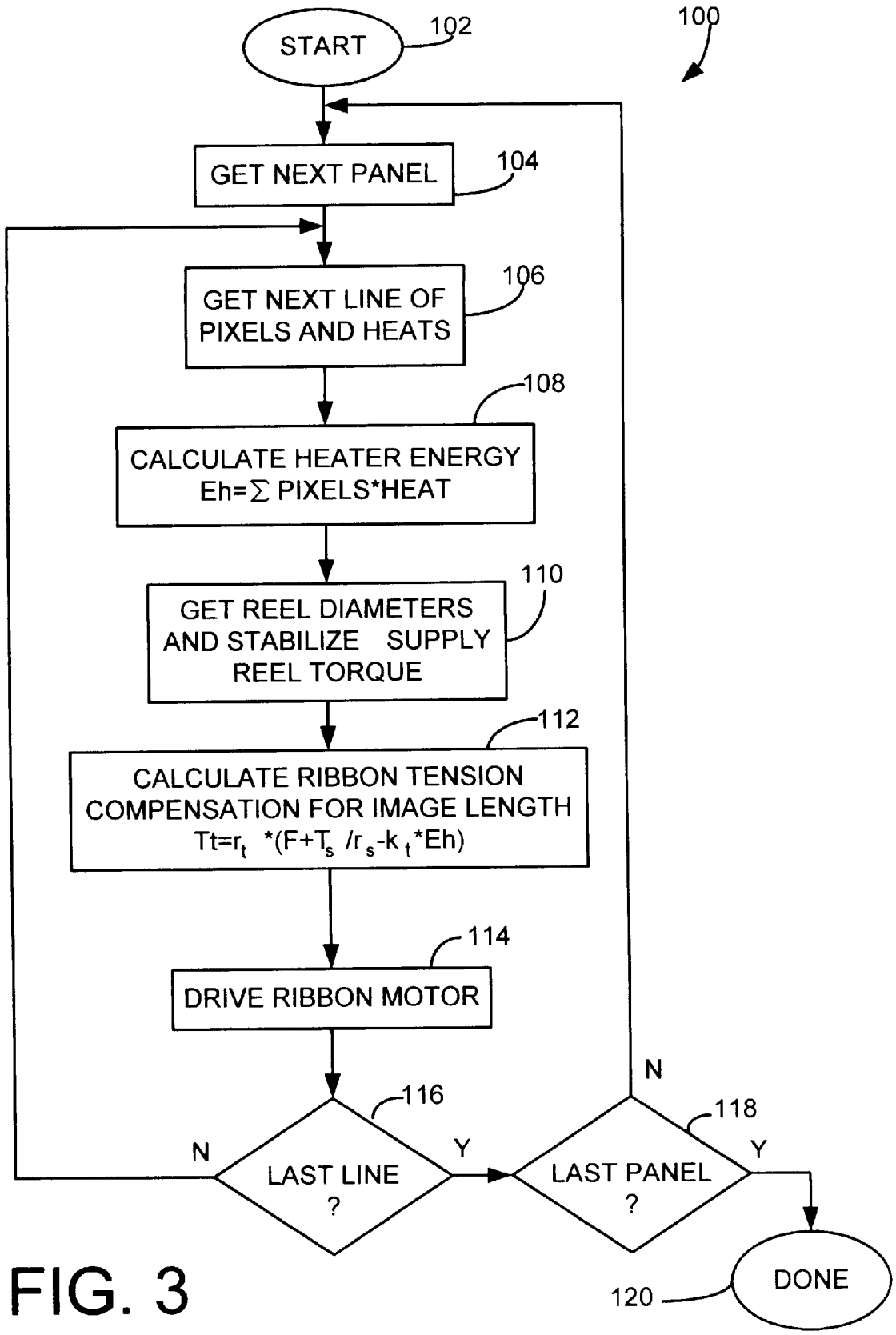
FIG. 3 is a simplified flow chart illustrating one example of steps performed by a controller in the printer of FIG. 1 to compensate for ribbon stretch.

FIG. 3 is a simplified flow chart 100 showing steps performed by printer 10, typically through microprocessor 18, in accordance with the present invention. The flow chart begins at start block 102 and control is passed to block 104 where microprocessor 18 obtains the information for the next panel to be printed. At block 106 the pixels for each line and the resultant heat is determined. At block 108, microprocessor calculates the heater energy based upon the information obtained at block 106. The heater energy Eh is determined as the summation of the number of pixels in a given line times the heating per pixel. At block 110, the diameter of the reels or spools 20 and 30 are determined and the force of the supply reel on the ribbon is calculated by assuming a given supply torque. At block 112, the ribbon tension compensation is calculated using Equation 3 and at block 114 the ribbon take-up motor 24 is driven accordingly. At block 116, microprocessor 18 determines if there are any further lines to be printed. If there are additional panels, control is returned to block 106. If there are no further lines, control passes to block 118 where microprocessor 18 determines if there are further panels to be printed. If there are, control is passed to block 104 where a subsequent panel is obtained. If there are no further panels, the printing process is complete and control is passed to block 120.

Using the techniques set forth herein, the present invention can provide improved printing by compensating for ribbon stretch in a thermal printer. The invention uses a control algorithm to control tension on the ribbon as a function of the heat applied to the ribbon. The control technique can also compensate for the change in torque arising from the change in the diameter of the ribbon spools. The invention can provide improved image quality in comparison to prior art printers which exhibit uncompensated ribbon stretch.

Although the present invention has been described with reference to preferred embodiments, workers skilled in the art will recognize that changes may be made in form and detail without departing from the spirit and scope of the invention. For example, the various algorithms can be implemented using any appropriate hardware, software or their combination. The various functions can be implemented using single piece components or implemented discretely using multiple components. The various drivers, motors, sensors and other components described herein are for illustrative purposes only and those skilled in the art will recognize that other components can be substituted. The invention can be used with single color/panel or multi-color/panel images. The web take-up and supply can be other configurations and are not limited to the spools or ribbons set forth herein. Other take-up and supply techniques can also be used. Further, the web can be in the form of a sheet which is transferred between the web supply and web take-up. For example, a large medium such as for a poster size image can be used.

What is claimed is:

1. A printer for printing an image onto a substrate using a web carrying a color material comprising:

a web supply adapted to supply the web;

a web take-up adapted to receive the web;

a print head configured to transfer material from the web to the substrate; and a controller configured to provide a control signal to the web take-up or supply as a function of heat energy applied to the web.

2. The printer of claim 1 including a temperature sensor having a temperature output related to heat energy applied to the web, wherein the control signal is a function of a temperature signal.

3. The printer of claim 1 wherein the print head is responsive to a print signal and the control signal is a function of the print signal.

4. The printer of claim 1 wherein the heat energy applied to the web is determined by the controller as a function of a number and intensity of pixels to be printed with the print head.

5. The printer of claim 1 wherein the web supply comprises a spool and the control signal is a function of a diameter of the spool.

6. The printer of claim 1 wherein the web take-up comprises a spool and the control signal is a function of a diameter of a spool.

7. The printer of claim 1 wherein the control signal is further a function of web tension.

8. The printer of claim 1 including a sensor configured to detect a color panel to be printed and wherein the control signal is a function of a color panel to be printed.

9. The printer of claim 1 including a sensor configured to detect a type of web and wherein the control signal is further a function of the type of web.

10. The printer of claim 1 wherein the control signal is a function of a color panel proximate the print head.

11. The printer of claim 1 wherein the control signal is a function of torque on a take-up reel Tt and heater line energy Eh which is calculated as:

$$Tt=rt*(F+Ts/rs-Kt*Eh)$$

where Tt is the torque on a take-up reel, rt is a radius of the take-up reel, Ts is a torque on a supply reel, Rs is a radius of the supply reel, Kt is a constant, and F is average predetermined web force.

12. The printer of claim 1 wherein the control signal is a pulse width modulated (PWM) signal.

13. The printer of claim 1 wherein the substrate comprises an identification card.

14. The printer of claim 1 wherein the web supply is responsive to the control signal.

15. The printer of claim 1 wherein the web take-up is responsive to the control signal.

16. The printer of claim 1 wherein the material carried on the web comprises a plurality of color panels.

17. The printer of claim 16 wherein there are at least two different colors.

18. The printer of claim 1 wherein the control is configured to correct for image size variations due to web stretches.

19. The printer of claim 1 wherein the web supply is controlled by a substantially constant torque clutch.

20. A method for printing an image onto a substrate using a web which carries a material color panels, comprising:

supplying the web;

taking up the web;

printing onto the substrate using a print head configured to transfer material from the web to the substrate; and controlling the supplying or taking up as a function of heat energy applied to the web.

21. The method of claim 20 wherein the controlling is a function of a signal provided to a print head.

22. The method of claim 20 determining temperature of the web to determine heat energy applied to the web.

23. The method of claim 20 wherein the heat energy applied to the web is determined by monitoring the number and temperature of pixels to be printed by the print head.

24. The method of claim 22 wherein determining temperature is through the use of a temperature sensor.

25. The method of claim 20 wherein supplying the web comprises rotating a spool.

26. The method of claim 20 wherein taking up the web comprises rotating a spool.

27. The method of claim 26 wherein the controlling signal is further a function of a diameter of the spool.

28. The method of claim 20 wherein the controlling signal is further a function of web tension.

29. The method of claim 20 wherein the controlling signal is further a function of a color of the material to be printed.

30. The method of claim 20 including sensing a type of web and wherein the controlling is further a function of the type of web.

31. The method of claim 20 wherein the controlling is a function of torque cn a take-up reel Tt and heater line energy Eh which is calculated as:

$$Tt=rt*(F+Ts/rs-Kt*Eh)$$

where Tt is the torque on a take-up reel, Rt is a radius of the take-up reel, Ts is a torque on a supply reel, Rs is a radius of the supply reel, Kt is a constant, and F is average predetermined web force.

32. The method of claim 20 wherein controlling comprises providing a pulse width modulated (PWM) signal.

33. The method of claim 20 wherein the substrate comprises an identification card.

* * * * *